US011828174B2

(12) United States Patent
Osgouei et al.

(10) Patent No.: US 11,828,174 B2
(45) Date of Patent: Nov. 28, 2023

(54) UTILIZING COBOTS FOR LAB PROCEDURES FOR THE PURPOSE OF TESTING AND GATHERING DATA

(71) Applicants: Reza Ettehadi Osgouei, Houston, TX (US); Eliah Everhard, The Woodlands, TX (US); Charles Anthony Thompson, Kingwood, TX (US); Mehrdad Gharib Shirangi, Houston, TX (US); Jason B. Norman, Houston, TX (US)

(72) Inventors: Reza Ettehadi Osgouei, Houston, TX (US); Eliah Everhard, The Woodlands, TX (US); Charles Anthony Thompson, Kingwood, TX (US); Mehrdad Gharib Shirangi, Houston, TX (US); Jason B. Norman, Houston, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 17/159,917

(22) Filed: Jan. 27, 2021

(65) Prior Publication Data

US 2022/0235656 A1 Jul. 28, 2022

(51) Int. Cl.
*E21B 49/08* (2006.01)

(52) U.S. Cl.
CPC ..... *E21B 49/0875* (2020.05); *E21B 49/086* (2013.01); *E21B 49/088* (2013.01)

(58) Field of Classification Search
CPC .... E21B 21/00; E21B 49/0875; E21B 49/086; E21B 49/088; E21B 47/00; G01N 24/081;
(Continued)

(56) References Cited

U.S. PATENT DOCUMENTS 6,378,627 B1 * 4/2002 Tubel ..... E21B 47/00 166/255.2
2013/0192360 A1 * 8/2013 Jamison ..... E21B 21/00 73/152.19

(Continued)

FOREIGN PATENT DOCUMENTS

CN 210603469 U 5/2020
WO WO-2009086495 A2 * 7/2009 ..... B25J 13/089
WO 2020131996 A1 6/2020

OTHER PUBLICATIONS

International Search Report and Written Opinion for International Application No. PCT/US2022/012118; International Filing Date Jan. 12, 2022; dated Apr. 22, 2022; 9 Pages.

*Primary Examiner* — Michael J Dalbo
*Assistant Examiner* — Kaleria Knox
(74) *Attorney, Agent, or Firm* — CANTOR COLBURN LLP

(57) ABSTRACT

A testing system for a wellbore operation and method of testing a fluid sample from a wellbore. A fluid sample is obtained from the wellbore operation. The fluid sample is received at a first test station having a first robot arm for performing a test on the fluid sample. A controller receives data on the wellbore operation, selects the test based on the data and controls the first robot arm to perform the test. A result of the test is used to adjust a parameter of the wellbore operation.

16 Claims, 7 Drawing Sheets

(58) Field of Classification Search
CPC ..... G05B 19/41815; G05D 1/0088; B25J 9/0087; G08G 5/0043
See application file for complete search history.

(56) References Cited

U.S. PATENT DOCUMENTS

| | | | | |
|---|---|---|---|---|
| 2013/0327159 | A1 | 12/2013 | Russell et al. | |
| 2014/0366673 | A1* | 12/2014 | Yamazaki | B25J 9/0087 901/23 |
| 2016/0378122 | A1* | 12/2016 | Guirguis | G01F 1/76 137/392 |
| 2017/0154371 | A1* | 6/2017 | Harvey | G05D 1/0088 |
| 2017/0210008 | A1* | 7/2017 | Maeda | B25J 9/1666 |
| 2018/0259466 | A1* | 9/2018 | Mitchell | G01N 24/081 |
| 2018/0339456 | A1* | 11/2018 | Czinger | G05B 19/41815 |
| 2018/0364713 | A1* | 12/2018 | Foster, II | G08G 5/0043 |
| 2020/0149394 | A1 | 5/2020 | Hao et al. | |

* cited by examiner

UTILIZING COBOTS FOR LAB PROCEDURES FOR THE PURPOSE OF TESTING AND GATHERING DATA

BACKGROUND

The present invention relates to a system and method for performing laboratory tests suitable for wellbore operations and, in particular, to a system and method for automated testing of fluids from a wellbore.

In the field of drilling and completions fluids, cementing, and other oil field operations in which fluids are involved, mud checks and routine laboratory tests are conducted to determine properties and composition of fluids retrieved from a wellbore. These tests are typically conducted with the use of several specially designed testing devices and can be conducted at a rig site, or in a suitable laboratory. Testing is limited to the time during which personnel are actively working, i.e., during work hours. Also, due to the number, complexity and coordination required among these tests, there is the possibility of error on the part of the lab personnel. Accordingly, there is a need to be able to automate the performance and scheduling of these tests.

SUMMARY

Disclosed herein is a testing system for a wellbore operation. The testing system includes a first robot arm for performing a test on a fluid sample at a first test station, the fluid sample obtained from the wellbore operation, and a controller that receives data on the wellbore operation, selects the test based on the data and controls the first robot arm to perform the test, wherein a result of the test is used to adjust a parameter of the wellbore operation.

Also disclosed herein is a method of testing a fluid sample from a wellbore. The method includes receiving the fluid sample at a first test station, the first test station having a first robot arm for performing a test on the fluid sample, receiving data on a wellbore operation at a controller, selecting, at the controller, the test based on the data, and controlling the first robot arm via the controller to perform the test.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
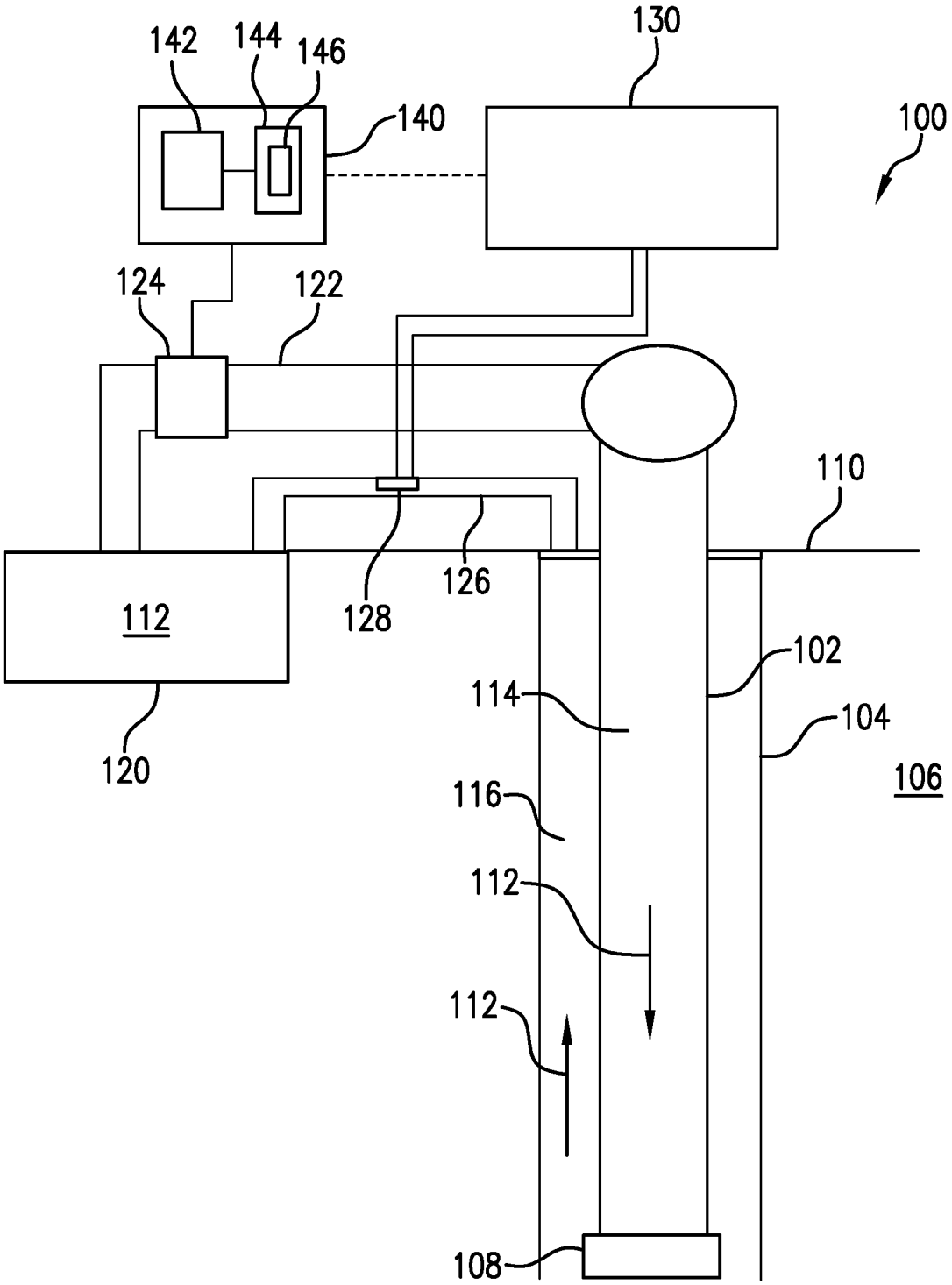
FIG. 1 shows a wellbore system in an illustrative embodiment.

Referring to FIG. 1, a wellbore system 100 is shown in an illustrative embodiment. The wellbore system 100 can be a drilling system, as shown in FIG. 1, or any other suitable system, such as a completion system, etc. The wellbore system 100 includes a drill string 102 for drilling a wellbore 104 in a formation 106. The drill string 102 includes a drill bit 108 at an end thereof and defines an inner bore 114 and an annulus 116 between the drill string 102 and a wall of the wellbore 104.

The wellbore system 100 further includes a mud pit 120 at a surface location 110 having a fluid 112 stored therein. Fluid 112 can include a drilling fluids or drilling mud, a completion fluid, a cementing fluid, a displacement fluid or other fluid used downhole or any combination thereof. A standpipe 122 serves as a conduit for flow of the fluid 112 from the mud pit 120 to an entry of the drill string 102 at a top of the drill string 102. A return line 126 allows for flow of fluid 112 and any wellbore fluids and cuttings entrained in the fluid 112 from the drill string 102 to the mud pit 120. Various devices (not shown) can be used to separate cuttings from the fluid 112 at the return line 126. During drilling, a mud pump 124 in the standpipe 122 pumps the fluid 112 from the mud pit 120 through the standpipe 122 and into the drill string 102. The fluid 112 flows downhole through the inner bore 114 of the drill string 102 and exits the drill string 102 via the drill bit 108 at the bottom of the wellbore 104. The fluid 112 then flows upward to the surface through the annulus 116 and returns to the mud pit 120 via the return line 126.

The return line 126 includes an inlet or valve 128 that allows the fluid 112 returning from the wellbore 104 to be collected or diverted to a testing laboratory 130. Alternatively, fluids 112 may be collected or diverted from mud pit 120. The testing laboratory 130 includes various equipment, disclosed in further detail herein, for performing tests on wellbore fluid, which includes the fluid 112 and/or any other fluids obtained from the wellbore 104. The results of the tests performed at the testing laboratory 130 can be sent to a system controller 140.

The system controller 140 includes a processor 142 and a memory storage device 144. The memory storage device 144 can be a solid-state device. A set of programs 146 are stored on the memory storage device 144. The processor 142 accesses the programs 146 in order to perform the methods disclosed herein. In various embodiments, the programs 146 can provide instructions to be used at the testing laboratory 130 to perform various tests, as disclosed herein. The system controller 140 can adjust a parameter of the wellbore system 100 based on the test results. In various embodiments, the system controller 140 can adjust a parameter of the fluid 112, such as chemical composition, density, etc. The system controller 140 can also adjust other parameters of the wellbore operation, such as a pumping rate of mud pump 124, etc.

Figure 2:
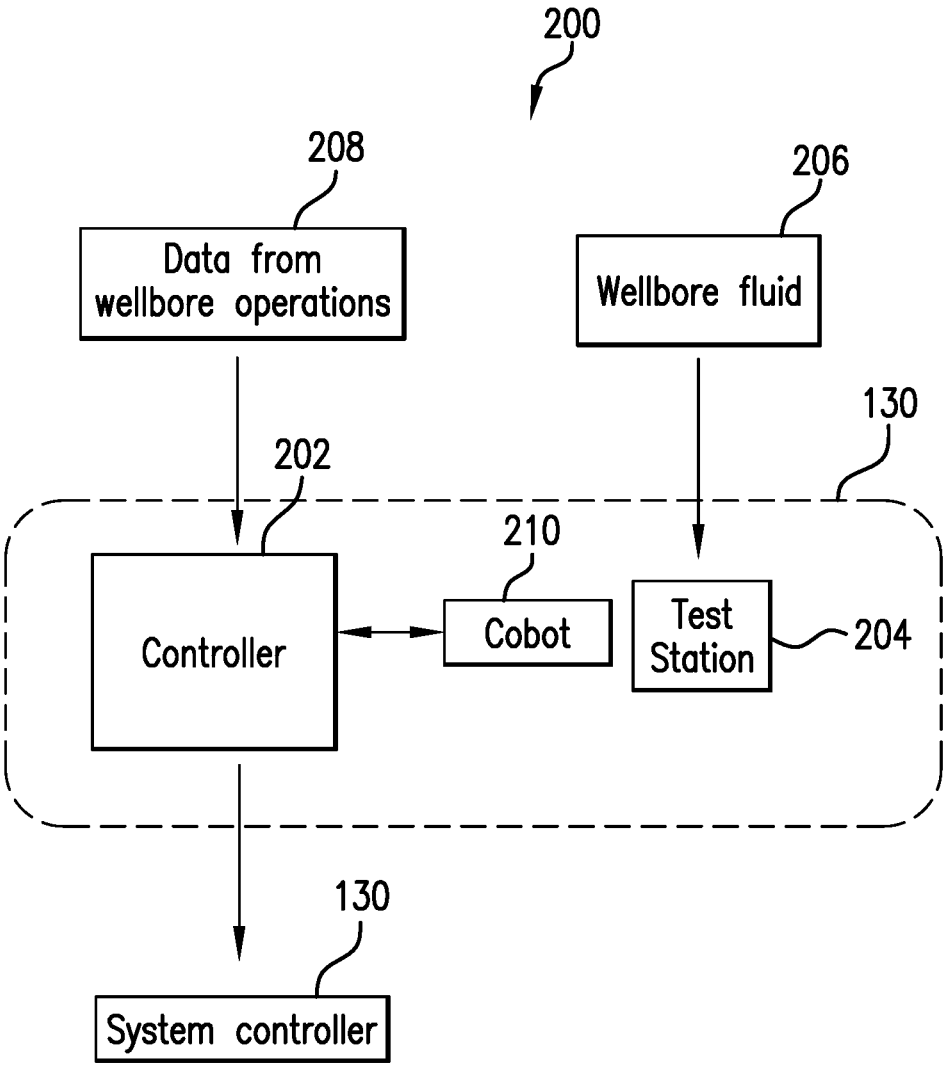
FIG. 2 shows a schematic diagram illustrating operation of the testing laboratory of the wellbore system, in an embodiment.

FIG. 2 shows a schematic diagram 200 illustrating operation of the testing laboratory 130 of the wellbore system 100, in an embodiment. The testing laboratory 130 includes a controller 202 and a test station 204, which can be one of a plurality of test stations at the testing laboratory 130. The test station 204 is set up to receive a fluid sample 206 and can include tools used to perform a designated test on the fluid sample obtained from the wellbore 104. The designated test can be, for example, API filtration, HPHT (High Pressure High Temperature testing), fluid loss, titration, rheology, electrical stability, pH, VSST (Viscometer Sag Shoe Test), PPT (Particle Plugging Test), or any test or fluid test requested by an operator. The controller 202 receives data concerning a wellbore operation and determines a test that is suitable to perform on the fluid sample 206 at the test station 204 based on the data. In one embodiment, the controller 202 sends instructions to a cobot 210 (collaborative robot) to perform the test. The cobot 210 can be one of a plurality of cobots at the testing laboratory 130. The cobot 210 operates various working devices for performing the test and obtaining test results. The test results can be communicated from the cobot 210 to the controller 202. The controller 202 can determine an adjustment to be made to the wellbore operation based on the test results and communicates that adjustment to the system controller 140 to be implemented by the system controller 140. Alternatively, the controller 202 can pass the test results to the system controller 140, which determines the adjustment to the wellbore operation based on the test results and makes the adjustment.

Figure 3:
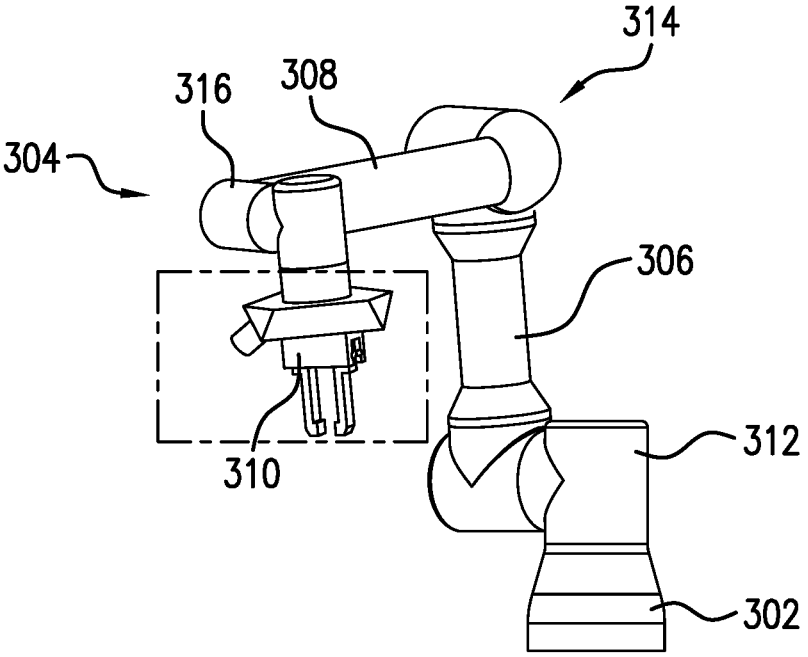
FIG. 3 shows a detailed view of the cobot in an illustrative embodiment.

FIG. 3 shows a detailed view of the cobot 210 in an illustrative embodiment. The cobot 210 includes a robot arm 304 supported by a base 302. The robot arm 304 can include an upper arm 306, a forearm 308 and end actuator 310. The upper arm 306 is coupled to the base 302 via a base joint 312 that allows the upper arm 306 to rotate with respect to the base 302 along several angular directions, including up/down and circumferentially around the base 302. The upper arm 306 is coupled to the forearm 308 via an elbow joint 314 that allows rotation of the forearm 308 about any of several axes through a selected angle with respect to upper arm or base joint. The forearm 308 is coupled to the end actuator 310 via a wrist joint 316. Rotation about any of several axes of the wrist joint 316 changes an angular relation between the end actuator 310 and the forearm 308 along several angular directions. Coordinated operation of the base joint 312, elbow joint 314 and wrist joint 316 can place the end actuator 310 at a selected location and orientation with respect to the base 302.

Figure 4:
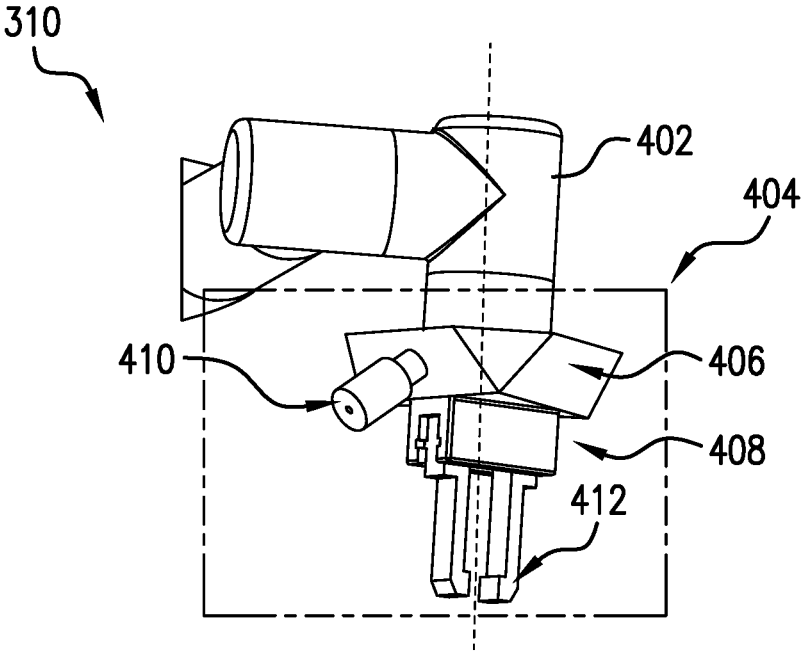
FIG. 4 shows the end actuator of a cobot in an illustrative embodiment.

FIG. 4 shows the end actuator 310 in an illustrative embodiment. The end actuator 310 can be designed to perform various operations suitable to the tests performed at the laboratory. The end actuator 310 includes a coupler 402 and a multifunctional interchangeable end-of-arm tool (MIET 404) that can be attached and separated from the coupler 402. In various embodiments, the MIET 404 is a 3D printed device. The coupler 402 can grasp or couple to the MIET 404 upon receiving a coupling command from the controller 202 or can release the MIET 404 upon receiving a release command from the controller 202. The robot arm 304 can thereby switch between MIETs based on testing requirements. Once the coupler 402 and MIET 404 are coupled, signals can be communicated between the controller 202 and the MIET 404 to operate the MIET and receive a test result from the MIET.

Each MIET 404 includes a plurality of support faces, such as side support surface 406 and front support surface 408. For example, the side support surface 406 supports a first working device 410 and the front support surface 408 supports a second working device 412. Each support face is capable having a working device attached or detached, thereby allowing the MIET 404 to have a plurality of configurations. A working device can be a device that performs a direct test on the fluid sample, such as a titration device, thermometer, etc. Alternatively, the working device can be a manipulation device that is capable of manipulation of the fluid sample or a component at the test station, such as a container, a knob, a control setting, etc. In various embodiments, the manipulation device includes a gripper for lifting and moving, a rotating collar to actuate valves, a rotating tool for fastening screws or other hardware, etc. Several working devices can be disposed on the same MIET, allowing the robot arm 304 to select a working device for use by rotating the MIET accordingly.

In one embodiment, the working device tool is a modified viscometer attachment for measuring the rheological properties of several preparations of fluids and a cleaning device for cleaning the viscometer between tests. In another embodiment, the working device is a pipette tool for conducting titrations, with cleanable or disposable pipettes suitable for handling different products. In other embodiments, the working device tool can include a scooping tool suitable for handling dry products, a fastener driver head for turning mechanical fasteners, etc. This list of tools is not intended to limit the scope of application of this invention.

Specific working devices of the MIET can vary from test station to test station. The robot arm 304 can be manipulated to rotate either of the first working device 410 and the second working device 412 into position with respect to a sample or test station to perform a test on a fluid sample using the tool.

Figure 5:
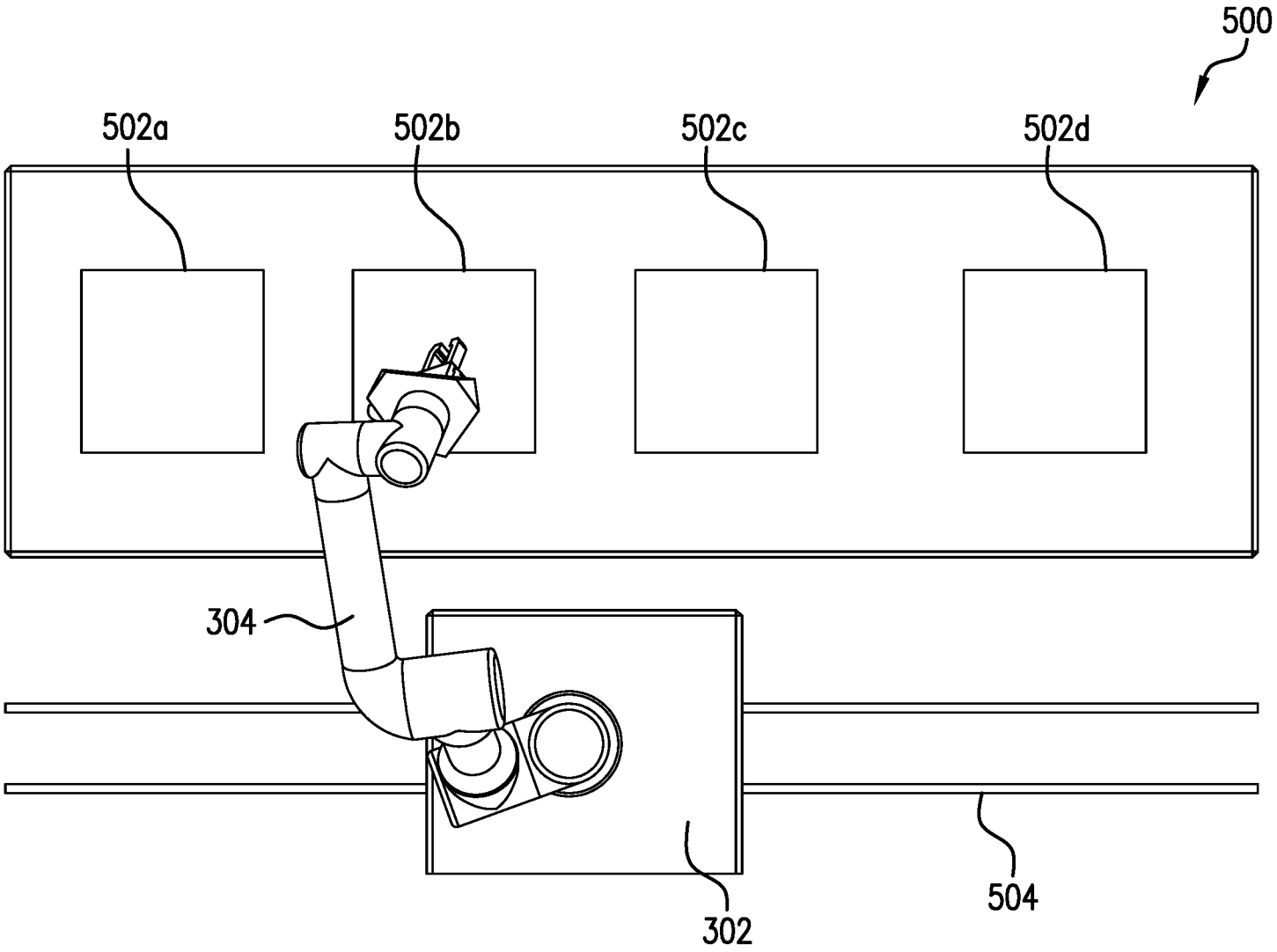
FIG. 5 shows a first laboratory arrangement for a cobot with respect to a plurality of fluid test stations.

FIG. 5 shows a first laboratory arrangement 500 for a cobot 210 with respect to a plurality of fluid test stations. The first laboratory arrangement 500 includes a first test station 502*a*, second test station 502*b*, third test station 502*c* and fourth test station 502*d*, which are aligned in a row. The cobot 210 includes the robot arm 304 supported by a base 302. The base 302 is placed on a track 504 that runs parallel to the test stations 502*a*-502*d* and is capable of moving along the track 504 under control of the controller 202. In an illustrative example, the cobot 210 can perform a first test at the first test station 502*a* and then move to the second test station 502*b* to perform a second test. The cobot 210 can move back and forth between test stations in order to perform an action at one test station while waiting for results from another test station or during a waiting period in the test being performed at the other test station.

Figure 6:
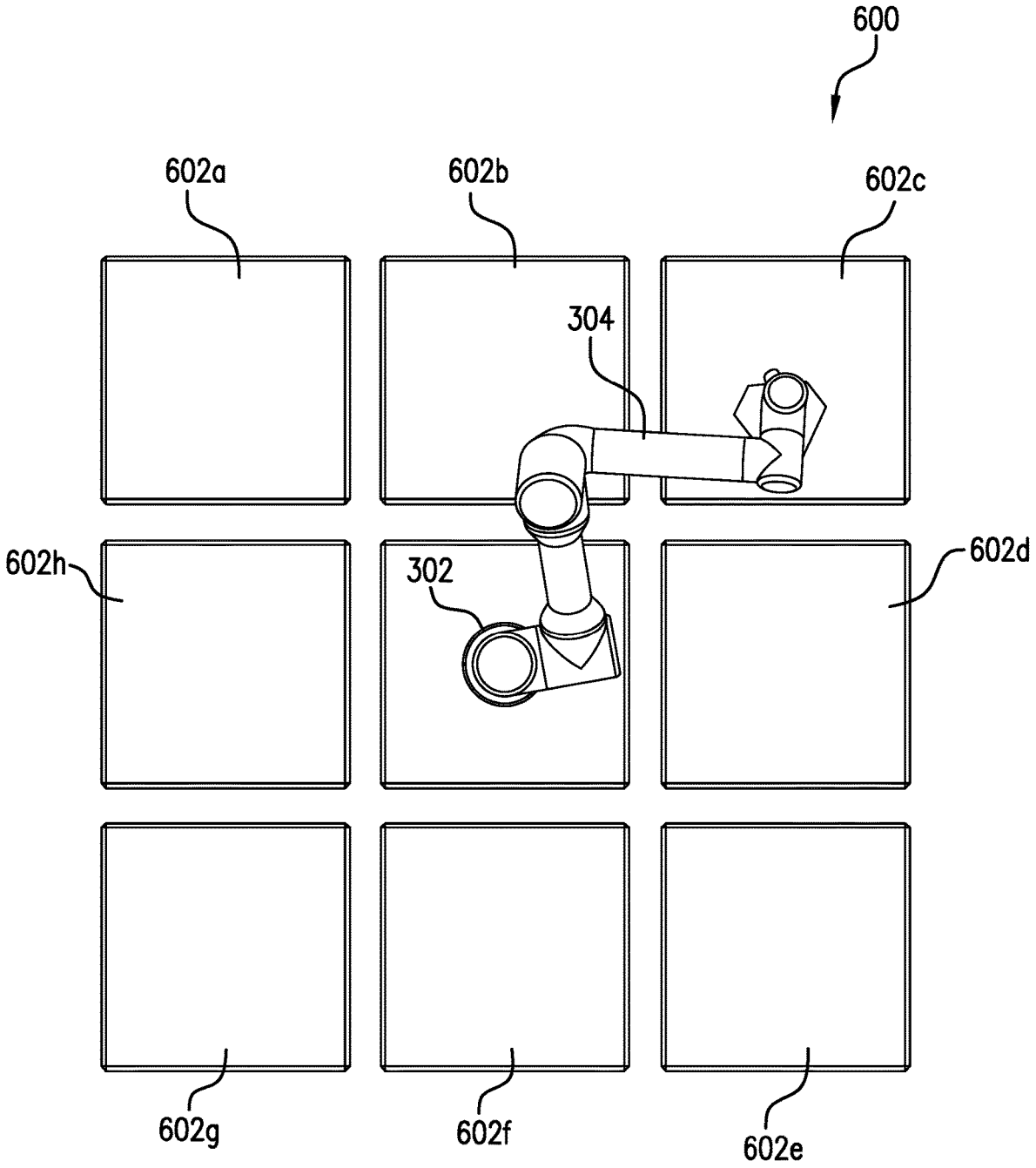
FIG. 6 shows a second laboratory arrangement for a cobot with respect to a plurality of test stations.

FIG. 6 shows a second laboratory arrangement 600 for a cobot 210 with respect to a plurality of test stations. The second laboratory arrangement 600 includes the plurality of test stations 602*a*-602*h* forming a group or cluster around the base 302 the cobot 210. The robot arm 304 is capable of rotating and/or swiveling from between test stations, such as between first test station 602*a* and second test station 602*b*, for example, as commanded by the master controller (not shown) to perform the tests at the respective test stations. A first MIET can be used at one first test station and then interchanged with a second MIET for use at another second test station. Alternatively, the first MIET can be used at both the first test station and the second test station.

Figure 7:
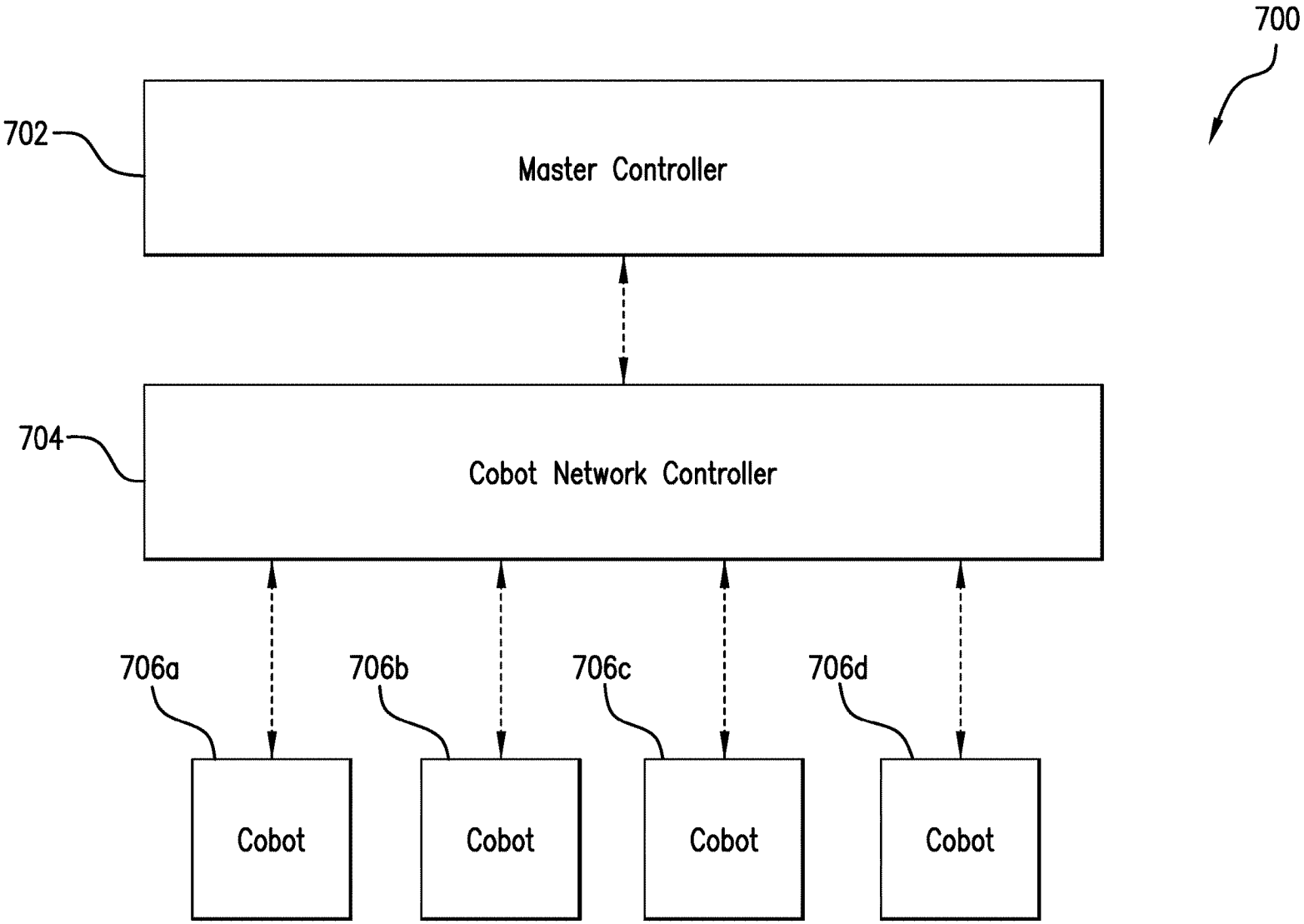
FIG. 7 shows a collaborative cobot system including a plurality of cobots working in collaboration with one another.

FIG. 7 shows a collaborative cobot system 700 including a plurality of cobots working in collaboration with one another. The collaborative cobot system 700 includes a master controller 702, cobot network controller 704 and the plurality of cobots 706*a*-706*d*. The master controller 702 coordinates the management of tasks and data. The cobot network controller 704 manages the individual actions and movements of each cobot 706*a*-706*d*. The cobot network controller 704 can prioritize tasks and determine an order of their execution, while keeping track of timed intervals and other considerations of the simultaneous tests. For example, the cobot network controller 704 can optimize when overlapping portions of simultaneous tests are to be executed. In various embodiments, this includes coordinating tasks using a time required for a cobot to perform a movement. The cobot network controller 704 can also operate one cobot to collaborate with another cobot in order to produce a test result.

In operation, the master controller 702 can send a requests or instruction to the cobot network controller 704, which sends an acknowledgement of receipt of the instructions to the master controller 702. The cobot network controller 704 then prioritizes, sequences, and executes individual tasks and records data to fulfill the request from the master controller 702. The cobot network controller 704 then sends confirmation, data, response, or other relevant information to the master controller 702 to close the original request.

Figure 8:
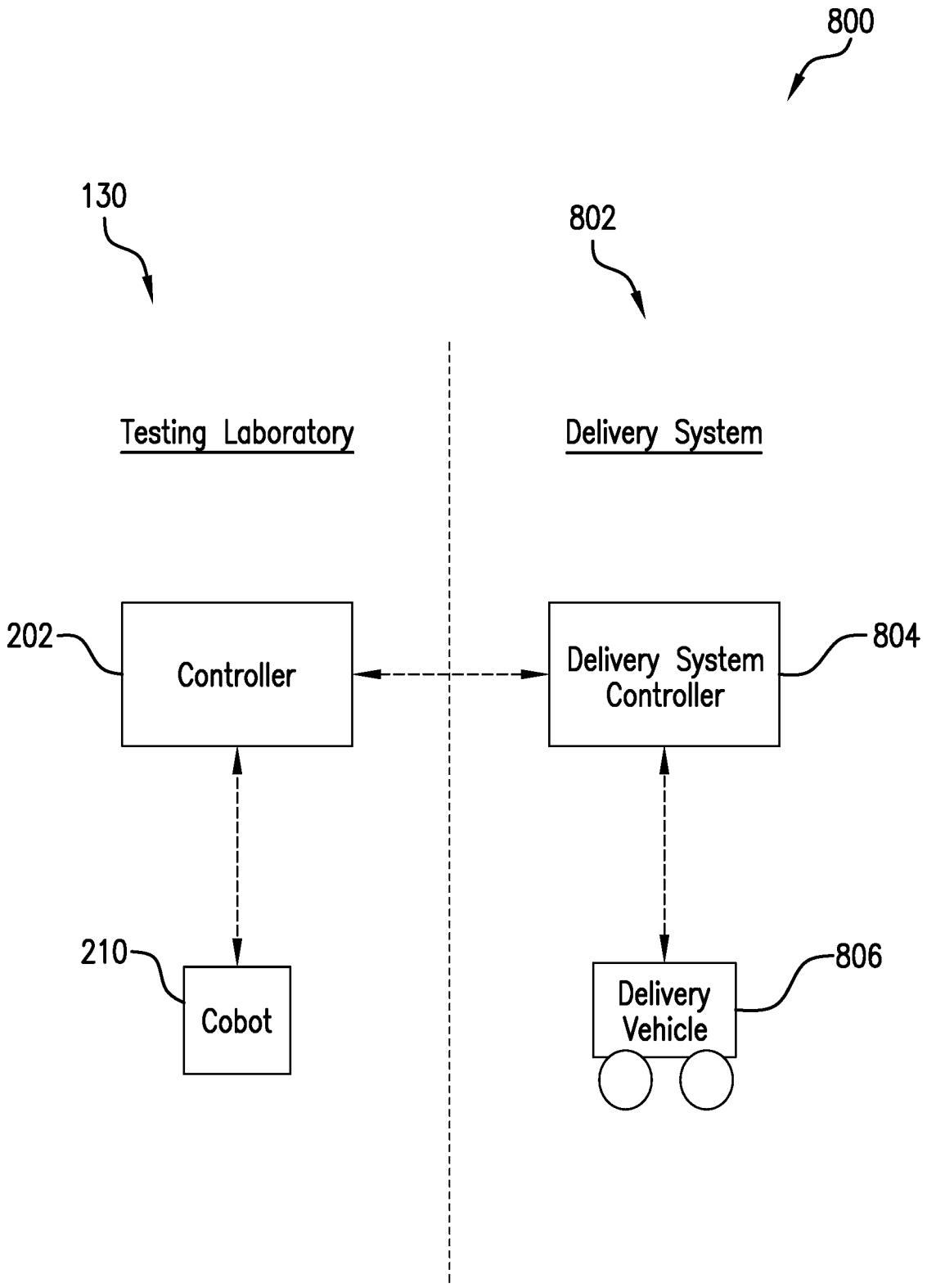
FIG. 8 shows a fluid testing system 800 including interactive fluid sample delivery.

FIG. 8 shows a fluid testing system 800 including interactive fluid sample delivery. The fluid testing system 800 includes a testing laboratory 130 and a delivery system 802. The testing laboratory 130 includes a controller 202 and a cobot 210, which can be a plurality of cobots. The delivery system 802 includes a delivery controller 804 and a delivery vehicle 806 which can be a plurality of vehicles. The delivery vehicle 806 can be an autonomous terrain vehicle, remote controlled terrain vehicle, a drone, etc. The delivery vehicle 806 can include instrumentation for collection, grabbing and/or holding a test sample in order to transport the test sample. In addition to controlling operation of the cobot 210, the controller 202 can communicate a delivery request to the delivery controller 804. The delivery controller 804 then sends a command to the delivery vehicle 806 to pick up and deliver a fluid sample to the cobot 210 or an associated test station, thereby fulfilling the delivery request.

Set forth below are some embodiments of the foregoing disclosure:

Embodiment 1. A testing system for a wellbore operation, including: a first robot arm for performing a test on a fluid sample at a first test station, the fluid sample obtained from the wellbore operation, and a controller that receives data on the wellbore operation, selects the test based on the data and controls the first robot arm to perform the test, wherein a result of the test is used to adjust a parameter of the wellbore operation.

Embodiment 2. The testing system of any prior embodiment, further comprising a delivery system in communication with the controller, the delivery system configured to fulfill a delivery request from the controller to deliver the fluid sample to the first test station.

Embodiment 3. The testing system of any prior embodiment, further comprising an interchangeable end-of-arm tool attachable to the first robot arm for performing the test.

Embodiment 4. The testing system of any prior embodiment, wherein the test includes at least one selected from the group consisting of: (i) API filtration; (ii) High Pressure High Temperature testing; (iii) fluid loss; (iv) titration; (v) rheology; (vi) electrical stability; (vii) pH; (viii) Viscometer Sag Shoe Test; (ix) Particle Plugging Test; (x) any other fluid test requested by an operator.

Embodiment 5. The testing system of any prior embodiment, wherein the interchangeable end-of-arm tool includes a plurality of working devices disposed thereon.

Embodiment 6. The testing system of any prior embodiment, wherein the first robot arm is configured to move along a track between the first test station and a second test station.

Embodiment 7. The testing system of any prior embodiment, wherein the first robot arm is configured to rotate between the first test station and a second test station.

Embodiment 8. The testing system of any prior embodiment, further comprising a second robot arm, wherein the controller operates the second robot arm to collaborate with the first robot arm.

Embodiment 9. A method of testing a fluid sample from a wellbore, including receiving the fluid sample at a first test station, the first test station having a first robot arm for performing a test on the fluid sample, receiving data on a wellbore operation at a controller, selecting, at the controller, the test based on the data, and controlling the first robot arm via the controller to perform the test.

Embodiment 10. The method of any prior embodiment, further comprising communicating a delivery request from the controller to a delivery system and fulfilling the delivery request at the delivery system to deliver the fluid sample to the first test station.

Embodiment 11. The method of any prior embodiment, further comprising performing the test use an interchangeable end-of-arm tool attached to the first robot arm.

Embodiment 12. The method of any prior embodiment, wherein the test includes at least one selected from the group consisting of: (i) API filtration; (ii) High Pressure High Temperature testing; (iii) fluid loss; (iv) titration; (v) rheology; (vi) electrical stability; (vii) pH; (viii) Viscometer Sag Shoe Test; (ix) Particle Plugging Test; (x) any other fluid test requested by an operator.

Embodiment 13. The method of any prior embodiment, wherein the interchangeable end-of-arm tool includes a working device, further comprising removing the working device from the interchangeable end-of-arm tool.

Embodiment 14. The method of any prior embodiment, further comprising moving the first robot arm along a track between the first test station and a second test station.

Embodiment 15. The method of any prior embodiment, further comprising rotating the robot arm between the first test station and a second test station.

Embodiment 16. The method of any prior embodiment, further comprising controlling, via the controller, the first robot arm and a second robot arm to collaborate with each other.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A testing system for a wellbore operation, comprising:

a first robot arm for performing a first test on a fluid sample at a first test station, the fluid sample obtained from the wellbore operation;

a second robot arm for performing a second test on the fluid sample at a second test station;

a controller that receives data on the wellbore operation and selects the first test and the second test based on a suitability of the first test and the second test to the wellbore operation indicated by the data; and a network controller that determines a sequence of the first test and the second test and prioritizes operation of the first robot arm and the second robot arm to during overlapping portions of the first test and the second test to allow the first robot arm and the second robot arm to produce a test result.

2. The testing system of claim 1, further comprising a delivery system in communication with the controller, the delivery system including a delivery controller and a delivery vehicle, the delivery controller configured to send a delivery request to the delivery vehicle, wherein the delivery vehicle is configured to collect a test sample and deliver the test sample to the first test station.

3. The testing system of claim 1, further comprising an interchangeable end-of-arm tool attachable to the first robot arm for performing the test.

4. The testing system of claim 3, wherein the test includes at least one selected from the group consisting of: (i) API filtration; (ii) High Pressure High Temperature testing; (iii) fluid loss; (iv) titration; (v) rheology; (vi) electrical stability; (vii) pH; (viii) Viscometer Sag Shoe Test; (ix) Particle Plugging Test; (x) any other fluid test requested by an operator.

5. The testing system of claim 3, wherein the interchangeable end-of-arm tool includes a plurality of working devices disposed thereon.

6. The testing system of claim 1, wherein the first robot arm is configured to move along a track between the first test station and a second test station.

7. The testing system of claim 1, wherein the first robot arm is configured to rotate between the first test station and a second test station.

8. The testing system of claim 1, further comprising a second robot arm, wherein the controller operates the second robot arm to collaborate with the first robot arm.

9. A method of testing a fluid sample from a wellbore, comprising:

receiving the fluid sample from the wellbore at a first test station, the first test station having a first robot arm for performing a first test on the fluid sample and a second robot arm at a second test station for performing a second test on the fluid sample;

receiving data on a wellbore operation at a controller;

selecting, at the controller, the first test and the second test based on a suitability of the first test and the second test to the wellbore operation indicated by the data; and performing, at a network controller:

determining a sequence of the first test and the second test; and prioritizing operation of the first robot arm and the second robot arm to during overlapping portions of the first test and the second test to allow the first robot arm and the second robot arm to produce a test result.

10. The method of claim 9, further comprising communicating a delivery request from the controller to a delivery system including a delivery controller and a delivery vehicle, sending the delivery required from the delivery controller to the delivery vehicle, collecting a test sample at the delivery vehicle and delivering the test sample to the first test station to fulfill the delivery request.

11. The method of claim 9, further comprising performing the test use an interchangeable end-of-arm tool attached to the first robot arm.

12. The method of claim 11, wherein the test includes at least one selected from the group consisting of: (i) API filtration; (ii) High Pressure High Temperature testing; (iii) fluid loss; (iv) titration; (v) rheology; (vi) electrical stability; (vii) pH; (viii) Viscometer Sag Shoe Test; (ix) Particle Plugging Test; (x) any other fluid test requested by an operator.

13. The method of claim 11, wherein the interchangeable end-of-arm tool includes a working device, further comprising removing the working device from the interchangeable end-of-arm tool.

14. The method of claim 9, further comprising moving the first robot arm along a track between the first test station and a second test station.

15. The method of claim 9, further comprising rotating the robot arm between the first test station and a second test station.

16. The method of claim 9, further comprising controlling, via the controller, the first robot arm and a second robot arm to collaborate with each other.

* * * * *